US007717041B2

(12) United States Patent
Garms et al.

(10) Patent No.: US 7,717,041 B2
(45) Date of Patent: May 18, 2010

(54) DEVICE FOR GENERATING PYROTECHNIC EFFECTS

(75) Inventors: Thomas Garms, Beverstedt (DE); Oliver Schultz, Bremerhaven (DE); Arthur Detlef Zahn, Schiffdorf (DE)

(73) Assignee: Chemring Defence Germany GmbH (DE)

( * ) Notice: Subject to any disclaimer, the term of this patent is extended or adjusted under 35 U.S.C. 154(b) by 879 days.

(21) Appl. No.: 11/297,975

(22) Filed: Dec. 8, 2005

(65) Prior Publication Data

US 2006/0162602 A1 Jul. 27, 2006

(30) Foreign Application Priority Data

Jan. 4, 2005 (DE) ..... 10 2005 000 769
Sep. 27, 2005 (DE) ..... 10 2005 046 305

(51) Int. Cl.
*F42B 4/00* (2006.01)

(52) U.S. Cl. ..... 102/335; 102/380; 102/358; 102/355

(58) Field of Classification Search ..... 102/360, 102/338, 358, 281, 531, 335, 355, 356
See application file for complete search history.

(56) References Cited

U.S. PATENT DOCUMENTS 3,349,710 A 10/1967 Sposimo
3,435,765 A 4/1969 Heinz et al.
4,294,173 A 10/1981 Ferri et al.
4,819,562 A * 4/1989 Bowman ..... 102/281
5,554,817 A * 9/1996 La Mura et al. ..... 102/217
6,474,212 B1 11/2002 Grazioli et al.
2003/0047064 A1 3/2003 Dittrich et al.
2003/0168097 A1 * 9/2003 Delapierre ..... 137/68.13

FOREIGN PATENT DOCUMENTS

FR 1 460 618 A 2/1967
FR 2 375 573 A 7/1978
FR 2 759 159 A 8/1998
GB 2138546 A * 10/1984

* cited by examiner

*Primary Examiner*—Michael Carone
*Assistant Examiner*—Gabriel J Klein
(74) *Attorney, Agent, or Firm*—Smith, Gambrell & Russell

(57) ABSTRACT

A simple device for generating pyrotechnic effects, in which an enveloping body (11) is formed from a plurality of interconnected plate-like layers between which the pyrotechnic charges (10) as well as the igniter means (12) are embedded. A configuration of the igniter means (12) as heating resistors, in particular as heating resistors whose conductors run in a meandering path. Such igniter means (12) are particularly suitable for use in the formation of a plate-like enveloping body consisting of a plurality of layers. By virtue of this enveloping body, the device assumes a shape comparable to that of a credit card or bank card.

24 Claims, 7 Drawing Sheets

DEVICE FOR GENERATING PYROTECHNIC EFFECTS

BACKGROUND OF THE INVENTION

1. Technical Field

The invention relates to a device for generating pyrotechnic with preferably a plurality of pyrotechnic charges and igniter means which are housed in a common enveloping body, and with a plurality of pyrotechnic charges and igniter means assigned to the pyrotechnic charges.

2. Prior Art

Pyrotechnic effects are employed for training purposes in civil defense and military exercises. When used inside buildings, for example in MOUT exercises, the pyrotechnic effects are generated by minute quantities of pyrotechnic effect charges.

Prior art devices of this type are known in which the effect charges for generating the pyrotechnic effects are housed in an enveloping body configured in the shape of tube or sleeve. The effect charge is ignited by electric igniter pellets. These pellets as well as the placement of the effect charges in the tubular or sleeve-like enveloping body make the production of such known devices very costly and complicated. This is particularly the case if a number of pyrotechnic effects are disposed in the same enveloping body. Here the ignition of the individual effect charges using igniter pellets has proven to be particularly complex.

The object of the invention is to provide a device for generating pyrotechnic effects that is simple to manufacture, in particular if it has a large number of pyrotechnic effects, while ensuring a high degree of reliability in its operation.

BRIEF SUMMARY OF THE INVENTION

A device for achieving this object is a device for generating pyrotechnic effects with preferably a plurality of pyrotechnic charges and igniter means which are housed in a common enveloping body, characterized in that the enveloping body is formed from a plurality of layers disposed one above the other and connected to each other. Since the enveloping body is made of at least two interconnected layers which lie on top of one another, it is very simple to produce. It is also just as simple to arrange the at least one pyrotechnic charge and the associated igniter means between the layers. It is also conceivable to connected the igniter means with a layer, thus completely eliminating the separate assembly of the igniter means as required in the known devices of this kind. Preferably the individual layers are configured at least in part as a flat surface. The layers can be manufactured quite easily from film, material webs and/or panels. Here the individual layers preferably have approximately the same surface area. If necessary, the layers made of film, webs or panels can first be connected to each other and then punched out together in a single operation to achieve their intended size.

At least one layer is made from a relatively stable material which, although it can exhibit some degree of elasticity, provides the enveloping body with a plate-like shape in the style of a credit card or bank card. Such a layer is preferably made of a thin plate which at least in part consists of an insulating material, such as plastic. The plate can also be multi-layer in design through lamination. All other layers can be formed from a thin foil or web. These layers, which themselves do not require any load-bearing properties and are therefore slack, can also assume a form similar to a painted coating or be formed from a paint.

Pursuant to a preferred embodiment of the device, one layer is associated with at least the igniter means. The igniter means and preferably also the conductor paths and contacts leading to the igniter means are disposed preferably on one side of the layer in that they are applied to the top and bottom side by adhesive means, metallization, or the like. But it is also conceivable to arrange the igniter means in the interior of the layer. The igniter means are therefore formed right at the start of the production of this layer and do not have to be mounted later—since according to the invention they are integrated in the layer.

Also provided in the region of a respective igniter means is at least one opening or free space in the layer bearing this igniter means. The at least one opening makes the igniter means accessible to an igniter charge or directly to the pyrotechnic charge, namely the effect charge. In the process, the respective opening can at the same time serve to accommodate at least in part the igniter charge and/or the effect charge. If necessary, an opening is sufficient to accommodate the entire pyrotechnic charge of an effect if the device is employed inside buildings for simulation or training exercises because only minute quantities of pyrotechnics are necessary for this purpose. In addition, the receiving space for the pyrotechnics can be accorded an appropriate size by making the layer thicker than necessary and/or in that the opening has a surface area which not only extends over the entire area of the igniter means but, if necessary, has an even larger area.

Provided in another preferred embodiment of the device is that at least one cavity or a recess for receiving the respective pyrotechnic charge, in particular the effect charge, is arranged in at least one layer. This cavity or recess is configured such that sufficient space remains for receiving the pyrotechnics, namely the respective effect charge. The recess or the like then does not need to have any appreciable volume for accommodating the pyrotechnic charge in the layer bearing the at least one igniter means. In case larger amounts of pyrotechnics are required to form a set of effects, it is also conceivable that the at least one recess in the layer bearing the respective igniter means has a larger volume so that the recess and its associated cavity in the other layer has a receiving capacity for larger effect charges.

The cavity for accommodating at least a part of the pyrotechnics of each charge, preferably the entire pyrotechnic charge for an effect, can be created by a convexity or bulge in the layer having the respective cavity. This layer, in contrast to the other layers, is not configured as an even surface but is raised in the region of the cavities. For reasons of expediency, this is an outer layer at the top or bottom. These bulges or convexities make it possible to form cavities having the required volume. To this end, it is possible if necessary to achieve in particular a depth of the respective convexity or bulge which is a multiple of the thickness of the respective layer.

In the preferred embodiments of the device, the partially bulged or otherwise structured layer for forming the cavities has at least one predetermined breaking point. The predetermined breaking point is located in a region of each cavity such that when the effect charge is ignited, the layer in the region of the effect charge can tear open in a targeted fashion, i.e. that the outer layer, as controlled by the predetermined breaking point, easily opens in the region of the cavity that has the respective effect charge. Thus, when a pyrotechnic charge is ignited, this arrangement reliably ensures that only the cavity with the ignited charge opens, but with the device remaining otherwise intact. This is especially important when the device has a plurality of pyrotechnic charges which are usually ignited in sequence. In this case, the ignition of one pyrotechnic charge should not affect the other pyrotechnic charges. This requirement is fulfilled by the predetermined breaking point assigned to the cavity of each pyrotechnic charge. In addition, the predetermined breaking point ensures that the parts of the bursting layer surrounding the cavity do not peel away from the enveloping body.

The enveloping body preferably has three layers, specifically a supporting, stable carrier layer, a circuit, or conductor, layer and a cover layer. The circuit layer and the top layer themselves do not require any supporting or load-bearing properties. In particular the top layer can be a thin insulating film or even merely a coating of paint. The electroconductive circuit layer is then at least partially embedded between the carrier layer, which is at least partially insulating, and the top layer, which is formed by, for example, paint or a foil. This cover layer preferably has cutouts in the region of the igniter means so that the igniter means are left open by the cover layer. This makes it possible to apply the pyrotechnic charges directly to the igniter means in either a dry and/or liquid form. The pyrotechnic charges are then covered by a separate cover coat or an adhesive. Such devices are particularly simple to construct. However, the cover layer of paint above the circuit layer can also be formed by a thicker carrier layer which has openings in the areas of the igniter means. This creates cavities in the thicker, plate-like cover layer which are capable of accommodating a larger quantity of pyrotechnic material or even a powder-like pyrotechnic charge. The cavities are sealed by a closing cover foil. But it is also conceivable to replace the cover layer with a convexity for the respective thin blister layer having the respective pyrotechnic charge.

In a preferred embodiment of the device, the preferred breaking point is formed by intersecting weakening lines which preferably extend only across the area of the respective convexity for forming at least one part of a cavity. The intersecting weakened lines can extend across the entire region of the cavity or merely across part of the cavity.

Pursuant to a preferred embodiment of the invention, an exposed outer area of an outer layer is assigned contacts which are freely accessible from the outside. The contacts are preferably specifically associated with the igniter means, namely connected to them in an electroconductive manner. This makes it easy to create an electroconducting connection between an appropriate firing apparatus and the respective igniter means. The device, which is manufactured on the basis of the invention's formation of interconnected layers, assumes the shape of a credit card or bank card, whereby it merely needs to be inserted into the firing apparatus in order to create the designated connection via the contacts with the respective igniter means.

Also provided by the invention is that device has at least one data storage means, in particular a chip. This makes it possible to assign specific values to the pyrotechnic charges, in particular in the form of data which, for example, can supply the firing apparatus with information necessary for the targeted ignition or the selective firing of the individual pyrotechnic charges of the respective device. Thus it is possible to operate different devices with the same firing apparatus, with the latter constantly being provided with individual data necessary for the selective triggering of the pyrotechnic charges, in particular the effect charges.

A further device for achieving the object set forth in the introduction, which can also be a preferred further development of the previously described device, is a device for generating pyrotechnic effects with a plurality of pyrotechnic charges and igniter means assigned to the pyrotechnic charges, characterized in that at least some igniter means are configured as heating resistors. Accordingly, at least one firing means is configured as a heating resistor. If the device has a plurality of pyrotechnic charges, preferably every pyrotechnic charge is assigned an igniter means configured as a heating resistor. However, it is also possible to assign different pyrotechnic charges to different igniter means, of which some are configured as heating resistor, with the others being conventional igniter means, such as electric igniter pellets. The igniter means can be made particularly easily with the heating resistor. In the simplest case, this involves a short section of a conductor path which then forms a heating resistor.

The or each heating resistor is preferably configured in a meandering fashion. This is a simple or complex winding pattern of fairly thin conductor paths which warm upon the slightest application of electricity and in extreme cases can be brought to a glow. This can result in the destruction of the heating resistor because each heating resistor is used only for the single ignition of an effect charge or an igniter charge since the device according to the invention is designed only for one-time use. The meandering heating resistor is sufficiently long, in particular when it is brought to a glow, to develop enough thermal energy to ignite the igniter charge or the effect charge.

It is also provided that the heating resistors or, if applicable, only a single heating resistor, are configured as part of a flexible or rigid circuit board. The heating resistors are then practically integrated in the circuit board, with the result that the meandering heating elements are immediately provided with their electric leads. In order that only the heating elements are targeted to warm up or glow for the controlled ignition of the pyrotechnical lead, they have a smaller cross section than the electric leads. Since the overall thickness of the circuit board is the same, i.e. the circuit board is just as thick in the regions of the meandering heating elements and the electric leads, the difference in the cross-section of the electric leads and the meandering heating elements is achieved by configuring the electric leads with a greater width than the meandering heating elements.

The circuit board with the meandering heating resistors is either attached to a surface of the layer bearing the circuit board or the circuit board is provided on both sides with a plastic laminated layer. In the latter case, the circuit board with the meandering heating resistors is embedded between the two plastic laminated layers, which in the former case the circuit board is lies exposed on a top surface.

BRIEF DESCRIPTION OF THE DRAWINGS

The preferred embodiments of the devices will be described in more detail in the following by means of the drawing, which shows.

DETAILED DESCRIPTION OF THE PREFERRED EMBODIMENTS

Figure 1:
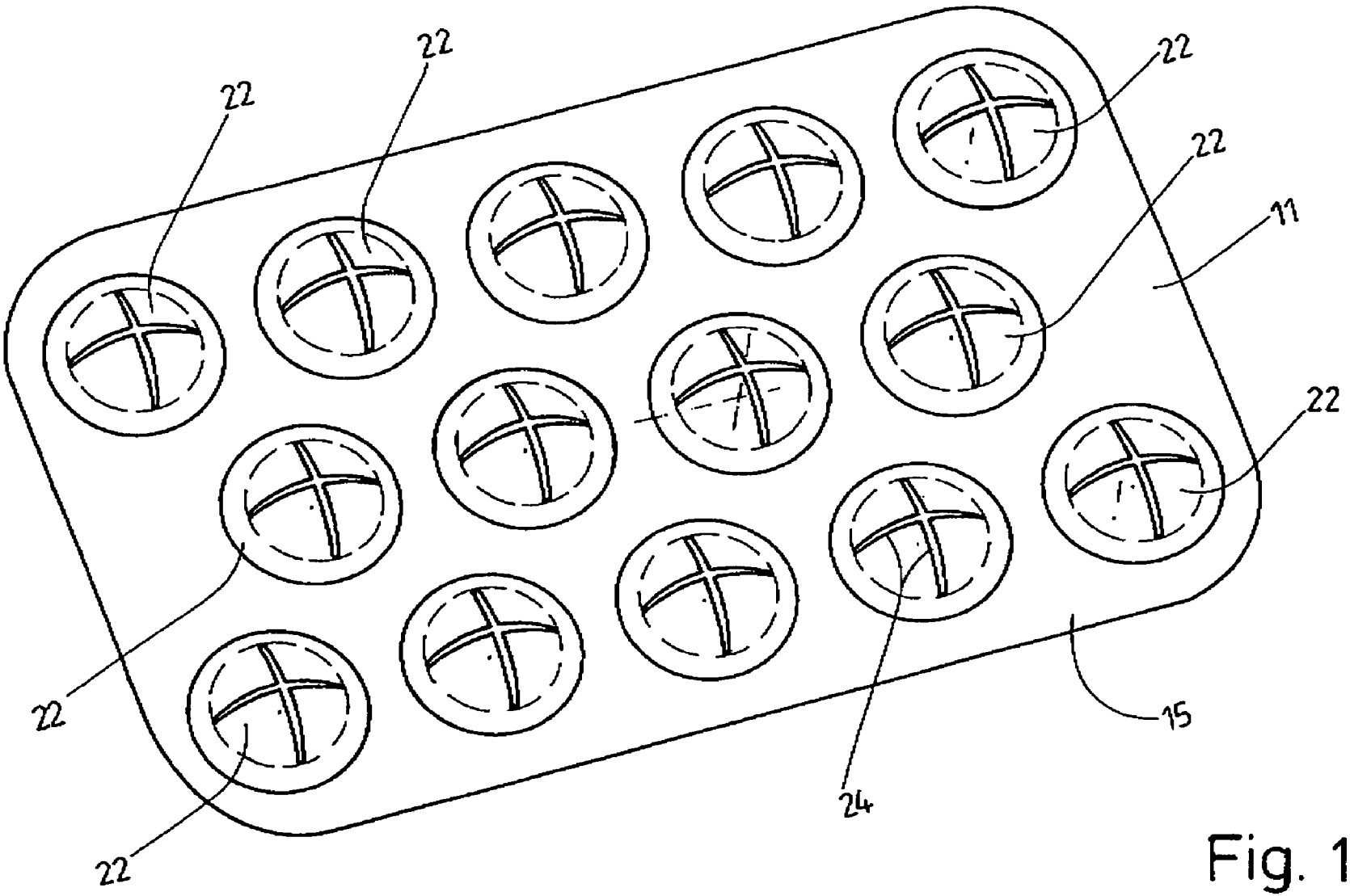
FIG. 1 shows a top side of the device in perspective view.

The devices shown in the figures are employed for training purposes in civil defense and military exercises, particularly in the interior of buildings when, for example, soldiers or police officers carry out realistic simulations of house-to-house combat or the storming of a building. Here the device is employed to generate the pyrotechnic simulation of gunfire, explosions or even stun grenades. But the possible uses of the device according to the invention is not limited to these example but can also be employed for other common simulations.

The shown device generates acoustic and/or optic simulations by means of igniting pyrotechnic charges. The devices shown in the figures have a plurality of pyrotechnic charges. The number of pyrotechnic charges in each device can vary according to the type of simulation. It is also conceivable that the device has only a single pyrotechnic charge and is thus employed only for the simulation of a single explosion or the like.

All devices according to the invention are characterized in that they have an essentially plate-like configuration. Preferably the devices assume a format corresponding to that of a credit card or bank card. Accordingly, the pyrotechnic charges and everything needed for their selective ignition is housed in a flat, plate-like enveloping body or assigned to same.

FIGS. 1 to 5 show a first exemplary embodiment of the device according to the invention. This device has fourteen pyrotechnic charges 10. The charges 10 are distributed in grid-like pattern on the surface of a plate-like enveloping body 11 of the device. However, any other arbitrary number of pyrotechnic charges 10 per device is also conceivable. The pyrotechnic charges 10 can be employed to generate the same pyrotechnic effects as well as different effects. In the following description, it will be assumed that all fourteen pyrotechnic charges generate the same effect, such as an explosion used to simulate the detonation of a hand grenade.

All fourteen pyrotechnic charges 10 are housed in the same plate-like enveloping body 11. But also disposed in the enveloping body 11 are igniter means 12, again preferably the same igniter means 12, so that each pyrotechnic charge 10 is associated with its igniter means 12. The igniter means 12 either ignite their associated pyrotechnical charges 10 directly or are assigned to priming charges (not shown in the figures), so that the igniter means 12 ignite the priming charges, which in turn ignite the pyrotechnic charges 10. Furthermore, the enveloping body 11 also contains conductors paths 13, which connect the igniter means 12 to contacts 14 which can be electrically connected to the corresponding contacts of a conventional firing apparatus (not shown), which, if necessary, also serves simultaneously as a control device.

The enveloping body 11, whose base area is approximately that of a credit card or bank card, comprises a plurality of layers. The individual layers have the same area and are connected to each other by sealing and/or adhesive bonding. The device shown here (FIGS. 3 and 4) has two layers of which a lower layer is configured as a multi-ply layer. The single-ply upper layer is a relatively stable carrier layer 15. Below that, the second layer in the shown exemplary embodiment is formed from interconnected sub-layers, specifically an upper laminate layer 16, a circuit layer 17 and a bottom laminate layer 18. In this case, therefore, the circuit layer 17 is completely embedded between the top laminate layer 16 and the bottom laminate layer 18. The carrier layer 15 and the laminate layers 16 and 18 are made of synthetic material, preferably a thermoplastic. The layers are preferably punched out of a continuous plastic web or film. The thickness of the layers shown in the figures is not drawn to scale in order to better illustrate the individual layers or sub-layers. In fact, at least some layers are much more thinner, in particular the individual sub-layers, such as the top laminate layer 16 and the bottom laminate layer 18. The same holds true for the circuit layer 17. In practice, the carrier layer 15 will therefore have a greater thickness than the underlying layer comprising the two laminate layers 16 and 18 and the circuit layer 17. In particular the top laminate layer 16 and the bottom laminate layer 18 can be made from a relatively thin plastic film having a thickness well under 1 mm, in particular in the range of 1/10 to 1/100 mm.

All layers or sub-layers are connected to each other, to a large degree across their entire surface area. This connection can be made by adhesive bonding, sealing or the like.

Figure 5:
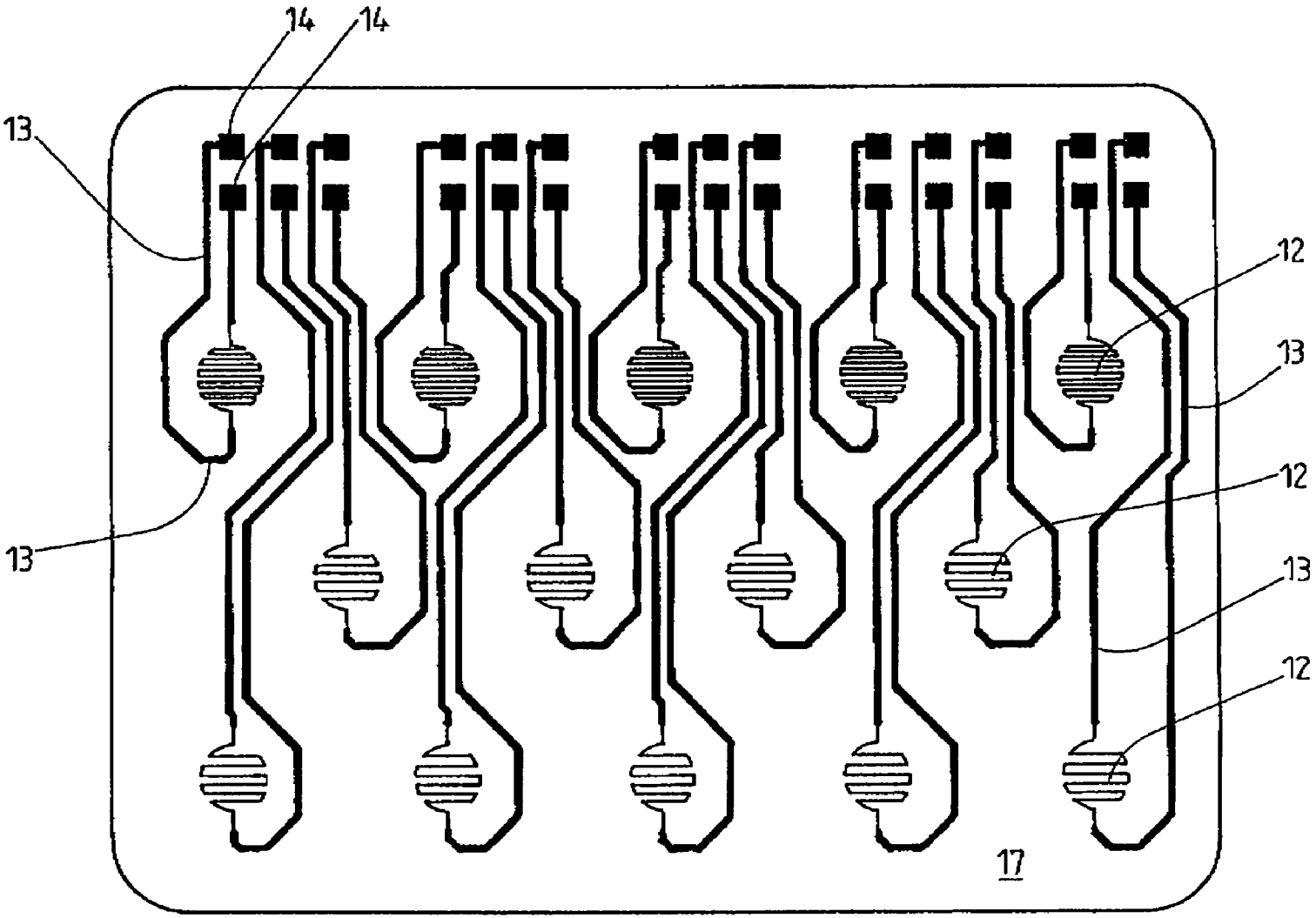
FIG. 5 shows a top view of a circuit board of the device.

FIG. 5 shows a top view of the circuit layer 17. It has a thin, electrically insulating carrier layer on which the conductor paths 13, contacts 14 and igniter means 12 are arranged as shown in FIG. 5. It is also possible to apply, preferably vaporize, the igniter means 12, conductor paths 13 and contacts 14 directly to the laminate layer 16 or 18, in particular the bottom laminate layer 18. The separate carrier film (not shown in the figures) of the circuit layer 17 can then be omitted. The fourteen igniter means 12 in the shown exemplary embodiment are placed on the circuit layer 17 where the pyrotechnic charges 10 are also located. The grid pattern of the igniter means 12 thus corresponds to the grid pattern of the pyrotechnic charges 10.

In a manner special to the invention, the identical igniter means 12 in the shown exemplary embodiment are designed as heating resistors. In the preferred exemplary embodiment of the invention, the heating resistors have a meandering design, thus exhibiting—in a top view—a winding path. The opposite ends of the meandering heating resistors for forming the igniter means 12 are each connected to a conductor path 13. The two conductor paths 13 assigned to each igniter means 12 are led to contacts 14 lying adjacent to one another. All contacts 14 are arranged in two parallel rows in the vicinity of a long edge of the circuit layer 17, specifically running parallel at different distances from the longitudinal edge in question. The meandering heating resistors which lie the closest to the contacts 14 have a greater number of densely adjacent conductor branches than the meandering heating resistors more distant from the contacts 14. The thickness of the conductor paths 13 and the contacts 14 is approximately the same. But in their width, the heating resistors are significantly smaller compared to the conductor paths 13 and the contacts 14. The meandering heating resistors thus have a smaller conductor cross-section, particularly with respect the conductor paths 13. As a result, the meandering heating resistors forming the igniter means 12 in the regions of the pyrotechnic charges 10, but not the conductor paths or the contacts 14, are heated to a glow by electric current supplied through the conductor paths 13. Due to the heating of the igniter means 12, the pyrotechnic chargers 10 or, if present, the igniter priming charges upstream of them, are thermally ignited.

Figure 4:
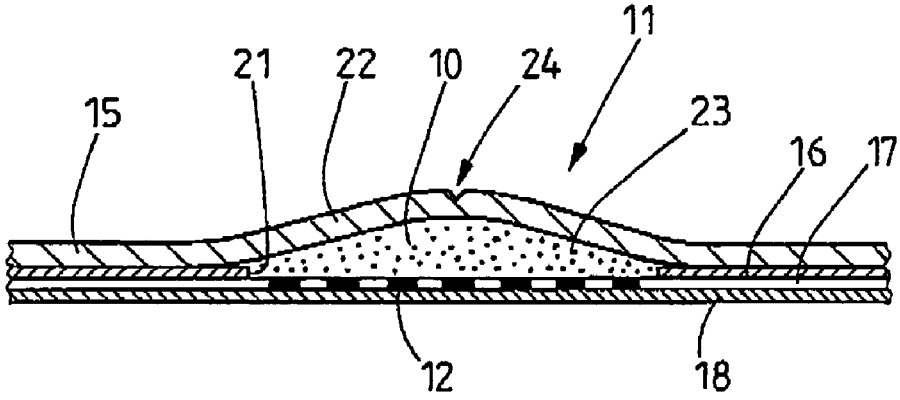
FIG. 4 shows an enlarged detail IV from the view of FIG. 3.

In the exemplary embodiment of FIGS. 1 to 5, where the circuit layer 17 with the igniter means 12 formed by the meandering heating resistors is embedded between laminate layers 16 and 18, the top laminate layer 16 facing the cover layer 15 is provided with openings 21 in the region of the igniter means 12. Each opening 21 in the top laminate layer 16 extends across the region of the meandering heating resistor forming the igniter means 12 (FIG. 4). Consequently, the heating resistor forming the igniter means 12 is exposed to the outer carrier layer 15.

At the point where the respective opening 21 and the igniter means 12 formed by the meandering heating resistor are located, the top (outer) carrier layer 15 has a convexity 22 projecting outwards. Thus, the carrier layer 15 is provided with a number of convexities 22 corresponding to the number of pyrotechnic charges 10. In the device shown here, there are thus fourteen convexities 22 present. All convexities 22 in the shown exemplary embodiment have the same design. But they can also have different sizes. Due to the convexities 22, the top side of the plate-like device is raised in certain areas, namely it is provided with projections (FIG. 1). In contrast, the opposite underside of the plate-like device is flat because only the carrier layer 15 is provided with local convexities 22 in the region of the pyrotechnic charges 10, but not the underlying layer comprising the laminate layers 16 and 18 and the interjacent circuit layer 17.

Formed in the region of each convexity 22 in the device is a cavity 23 between the carrier layer 16 and the igniter means 12 of the circuit layer 17. This cavity 23 is largely created by the convexity 22 of the carrier layer 15, but also in part by the opening 21 in the top laminate layer 16 above the circuit layer 17. Each cavity 23 serves to accommodate the pyrotechnic charge 10, namely the effect charge. The cavity 23 is dimensioned such that a required quantity of pyrotechnic mass can be accommodated within it. For example, the amount of pyrotechnic mass for each pyrotechnic charge 10 is between 0.1 g and 0.2 g. This small amount of pyrotechnic charge 10 is sufficient for indoor simulations. But it is also conceivable that, for other purposes, particularly those involving larger devices, the cavities 23 can be sized larger in order to accommodate larger pyrotechnic charges 10. If necessary, a pyrotechnic priming charge can also be disposed in the cavity 23 if the pyrotechnic effect charge cannot or should not be directly ignited by the igniter means 12 configured as a heating resistor. In that case, the pyrotechnic priming charge is located between the pyrotechnic effect charge 10 and the exposed thin heating conductors for forming the heating resistor of the igniter means 12.

The carrier layer 15 is provided with a predetermined breaking point in the region of each convexity 22. The predetermined breaking point results in a targeted, local weakening of the wall thickness of the carrier layer 15 in the region of each convexity 22. In the shown exemplary embodiment, each predetermined breaking point is formed by two weakening lines 24 which intersect at right angles (FIG. 1). In the region of each weakening line 24 the wall thickness of the carrier layer 15 is reduced by a sharp-edged indentation, preferably one having a V-shaped cross-section, on at least one side of the carrier layer 15. In FIG. 4 the carrier layer 15 has single-side, outer weakening lines 24 in the region of each convexity 22. But it is also conceivable to provide the weakening lines 24 only on the inner side of the carrier layer 15 or on both sides of the same, i.e. lying opposite one another. The two weakening lines 24 cross each other approximately in the middle of each convexity 22. The predetermined breaking point created by the weakening lines 24 brings about a controlled bursting of the carrier layer 15 only in the region of the convexity 22 when the pyrotechnic charge 10 is ignited. By limiting the weakening line 24 to the region of the respective convexity 22, the bursting of each cavity 23 is limited to the region of the respective convexity 22 for a pyrotechnic charge 10. This therefore prevents the entire device from bursting or tearing open when a pyrotechnic charge 10 is ignited and thus avoids any undesirable affect on the pyrotechnic charges 10 that have not yet been ignited. The predetermined breaking point can be omitted in a device having only one pyrotechnic charge 10, since no controlled bursting of the carrier layer 15 is required in a device which is "spent" as soon as its only pyrotechnic charge 10 has been fired.

In a variation of the exemplary embodiment shown in FIGS. 1 to 4, it is conceivable to provide the circuit layer 17 with a laminate layer on only one side. In that case, preferably only a bottom laminate layer 18 is present, meaning that the top laminate layer 16 is lacking. Here it is also no longer necessary to provide openings 21 in the regions of the igniter means 12 because the latter are already exposed on this side of the carrier layer 15 anyway. The conductor paths 13 leading to the igniter means 12 are then covered and insulated by the carrier layer 15, with the result that, outside of the regions of the pyrotechnic charges 10, the circuit layer 17 is embedded between the plastic carrier layer 15 and the bottom laminate layer 18.

Figure 6:
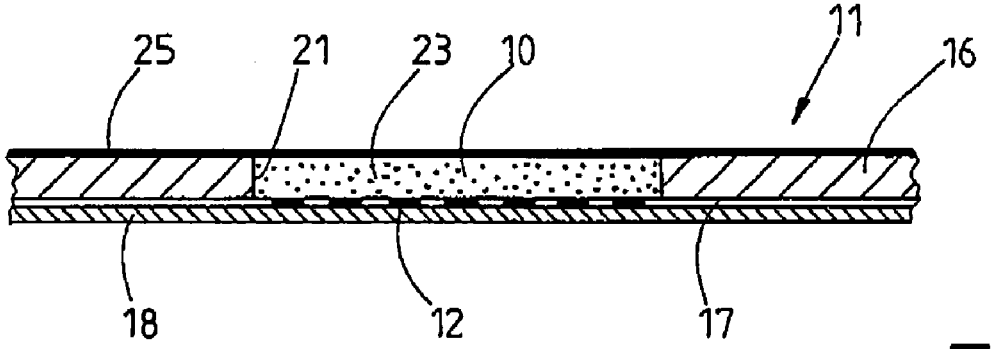
FIG. 6 shows a second exemplary embodiment of the device in a view analogous to FIG. 4.

FIG. 6 shows a detail from FIG. 4 in the region of a sectional view through a pyrotechnic charge 10 as can be provided in a device according to the second exemplary embodiment of the invention. In this case, two layers are also provided. In principle, the bottom layer can be configured like the bottom layer of the first exemplary embodiment of the device. Consequently, the same reference numbers will also be used to designate the same parts.

This bottom layer has a triple-ply configuration, comprising namely a top laminate layer 16, a bottom laminate layer 18 and an interjacent circuit layer 17. Here, too, the respective igniter means 12 is formed by a meandering heating resistor. The top laminate 16 has an opening 21 in the region of the respective igniter means 12. In contrast to the first exemplary embodiment of the invention (FIG. 4) the top laminate layer 16 is significantly thicker than the bottom laminate layer 18. The opening 21 over each igniter means 12 itself forms the cavity 23 for accommodating the pyrotechnic charge and, if necessary, a pyrotechnic priming charge. Due to the greater thickness of the top laminate layer 16, it serves as a carrier layer. The second layer, in contrast to the first exemplary embodiment, is then no longer designed as a carrier layer but serves as a cover layer 25. The cover layer 25, which may have relatively thin walls, can be most easily formed from a smooth film. By housing the pyrotechnic charge 10 in the device of FIG. 6 in the region of the thicker, top laminate layer 16, it is not necessary to provide the top side of the enveloping body 11 with convexities 22. For that reason, in the shown exemplary embodiment the enveloping body is completely flat in design on both sides, thus being indistinguishable from a credit card or bank card in its exterior view. The thin cover layer 25 tears open automatically when the pyrotechnic charge 10 is ignited and therefore requires no predetermined breaking point.

Figure 2:
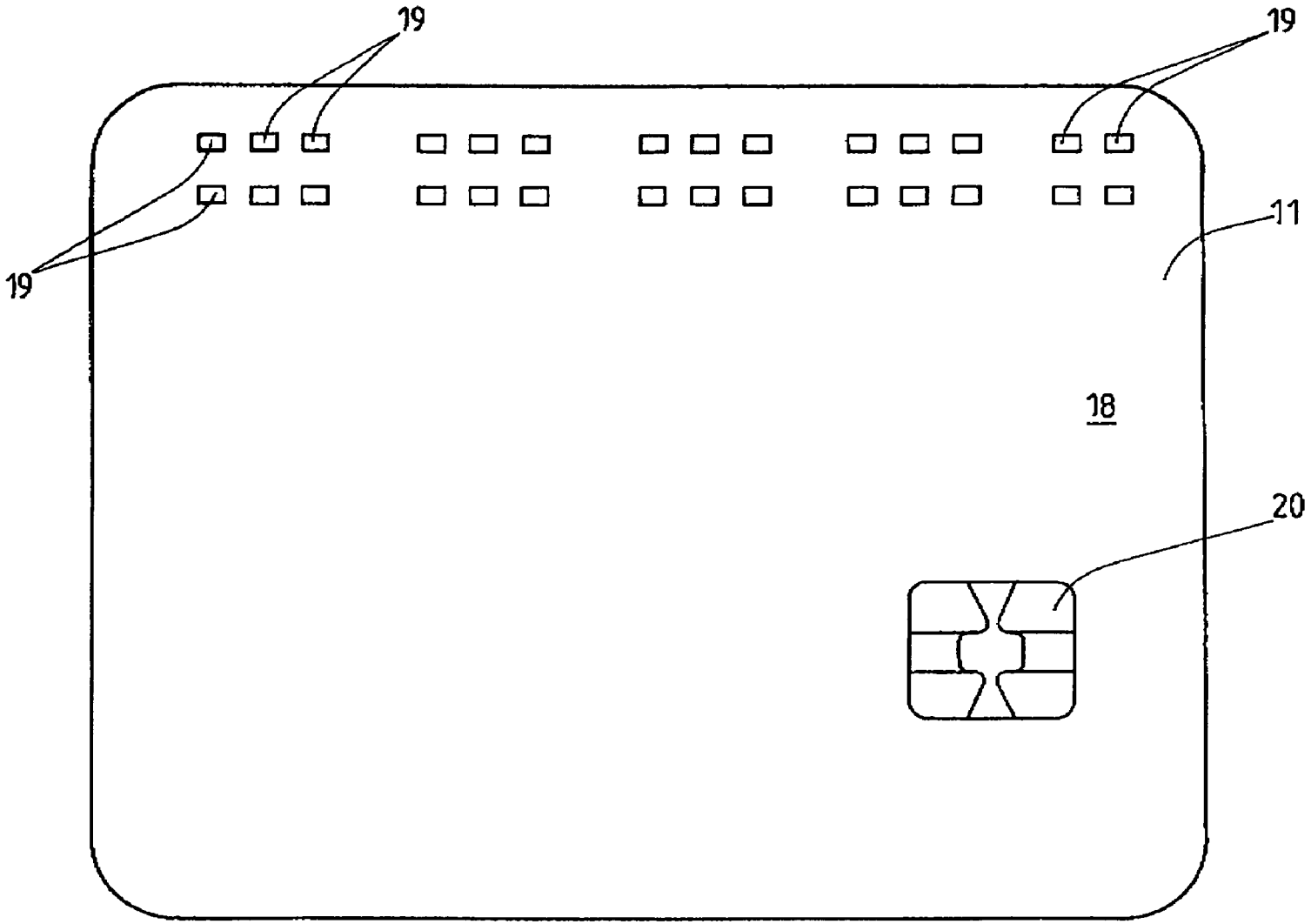
FIG. 2 shows a view of the bottom side of the device.
Figure 3:
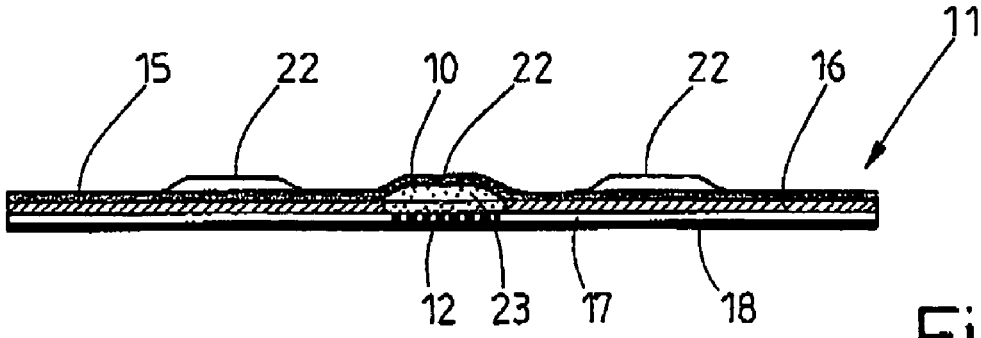
FIG. 3 shows a partial sectional view III-III through the device.

The flat bottom side of the device shown in FIG. 2 has cutouts 19 in the region of the contacts 14 of the circuit layer 17. The cutouts 19 are placed where the contacts 14 of the conductor paths 13 are located. This arrangement provides free access to the contacts 20 through the cutouts 19 in the lower laminate layer 18 for the corresponding contacts of the firing apparatus for igniting the individual pyrotechnic charges 10 of the device (FIG. 2).

Furthermore, the bottom side of the device has a data storage unit, which in the shown exemplary embodiment is designed in the manner of a chip 20 commonly found in credit cards or bank cards (FIG. 2). The chip 20 can be used to store data relevant to the device, in particular data concerning the number and type of the pyrotechnic charges 10 disposed in the enveloping body 11. When the device is inserted in the appropriate firing apparatus, the latter reads the data from the chip 20, thereby obtaining the necessary information, in particular the number of pyrotechnic charges 10 and their type. Thus it is possible for the firing apparatus to ignite the respective pyrotechnic charge 10 in a selected manner. In addition, the chip 20 also provides the firing apparatus 20 with information about which pyrotechnic charges 10 of the device have already been spent.

Figure 7:
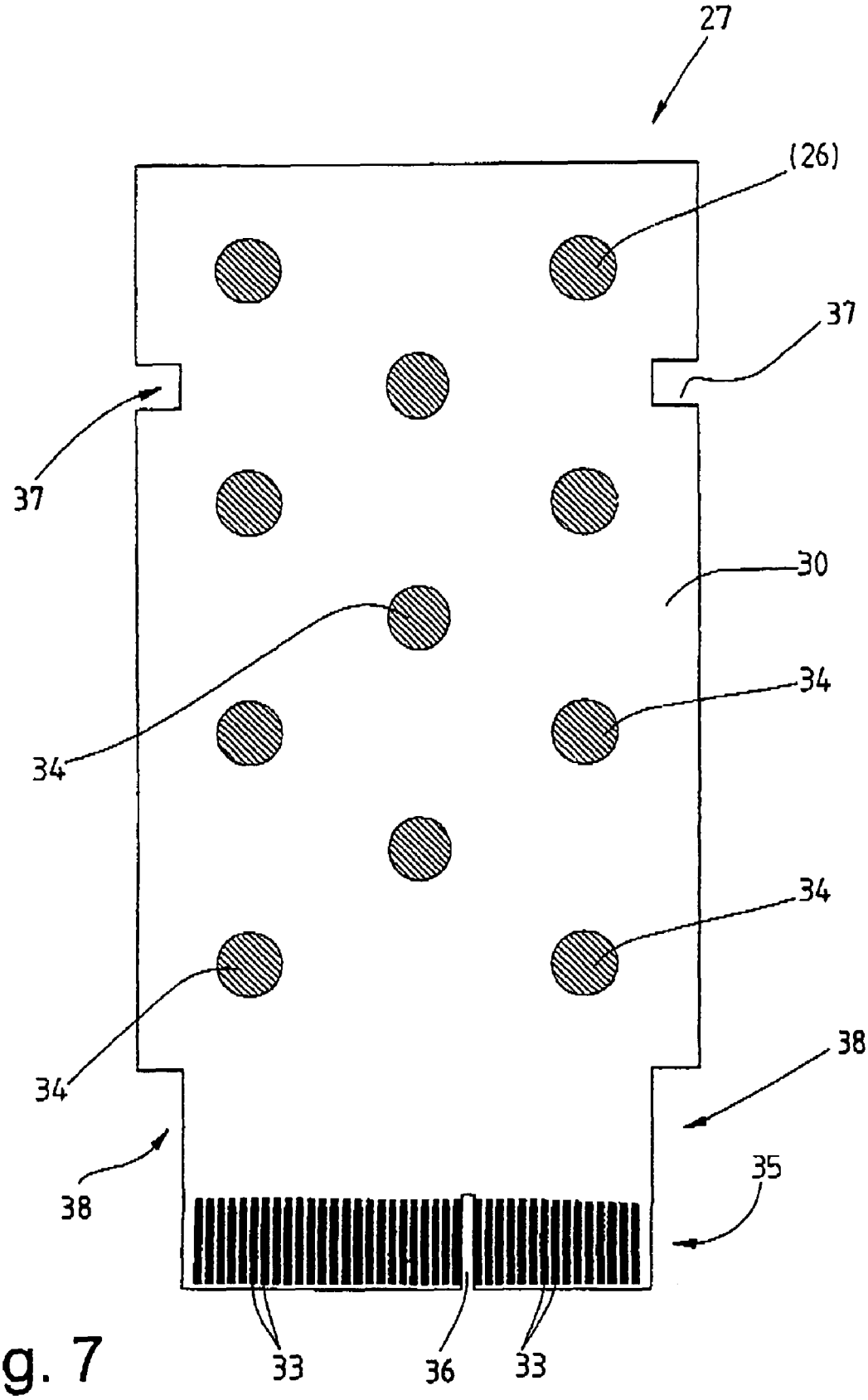
FIG. 7 shows a top view of a device pursuant to a third exemplary embodiment of the invention.
Figure 8:
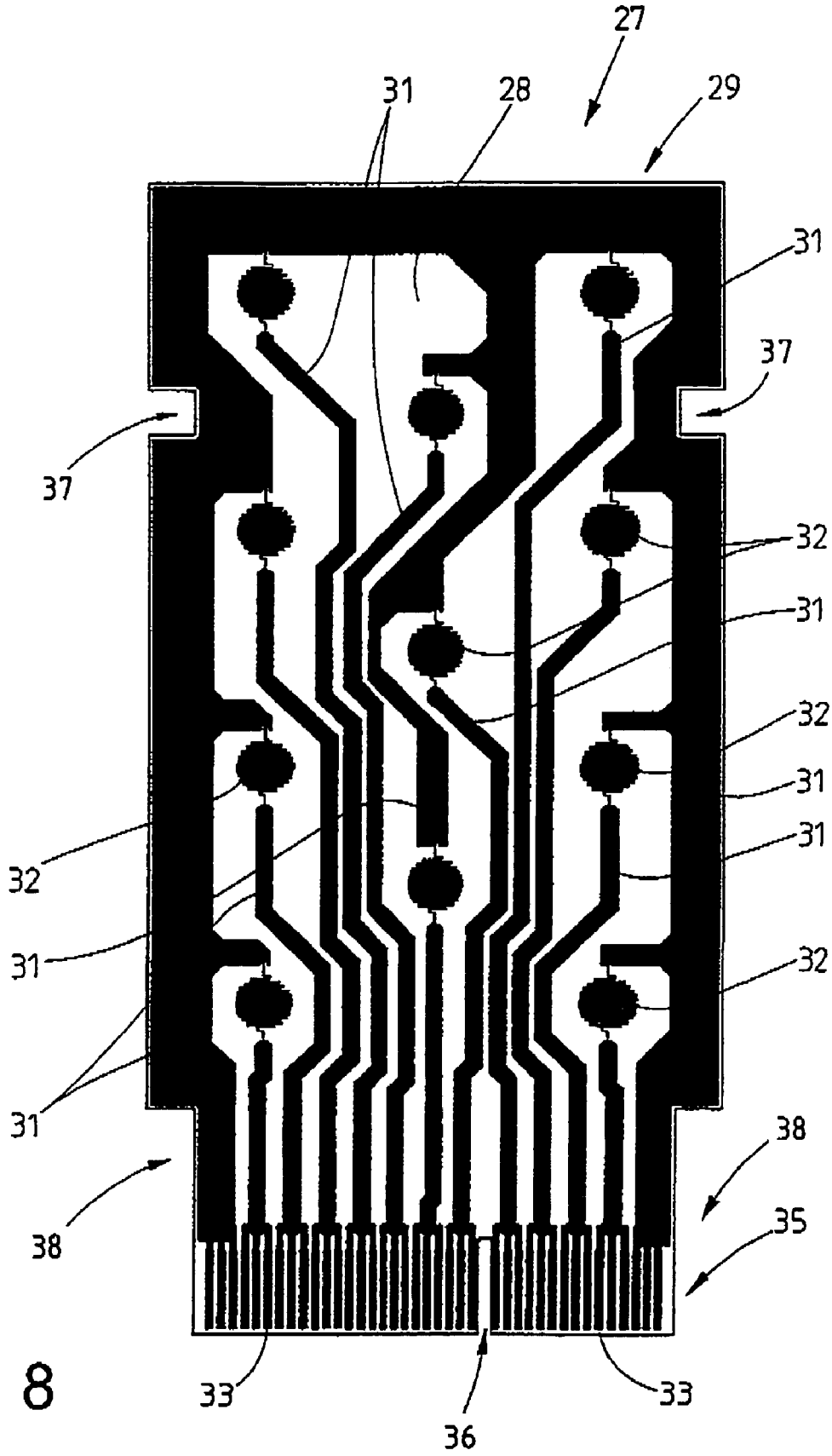
FIG. 8 shows a top view of the exposed conductor paths and igniter means on a circuit board of the device pursuant to FIG. 7.
Figure 9:
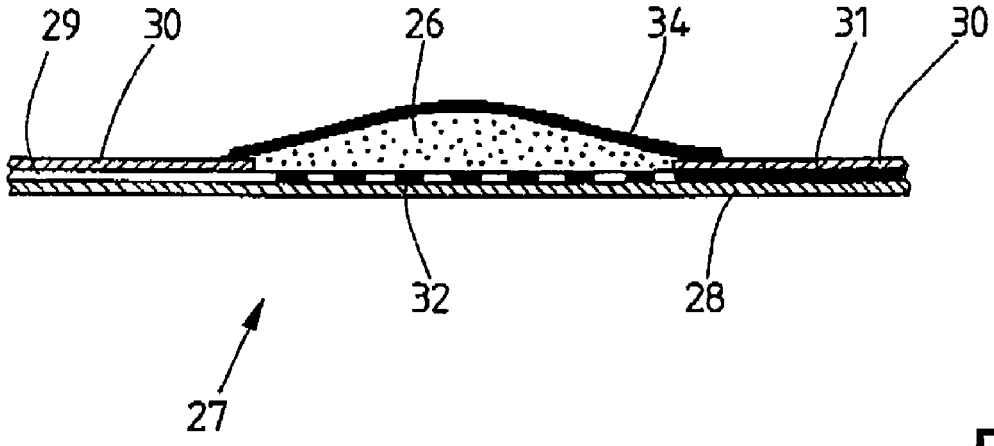
FIG. 9 shows an enlarged representation of the partial sectional view through a pyrotechnic charge of the device pursuant to FIGS. 8 and 9.

FIGS. 7 to 9 show a third exemplary embodiment of the device according to the invention. This device has only eleven pyrotechnic charges 26. The pyrotechnic charges 26 are distributed on the surface of the device's plate-like enveloping body 27 in a grid pattern. However, any arbitrary number of pyrotechnic charges 26 is also conceivable in this exemplary embodiment as well. The pyrotechnic charges 26 can serve to generate identical pyrotechnic effects or different pyrotechnic effects. In the following description, it will be assumed that all pyrotechnic charges 26 generate the same effect, for example an explosion.

In the shown exemplary embodiment, the plate-like enveloping body 27, to which the eleven pyrotechnic charges 26 are assigned, is also configured with the shape and area approximating that of a credit card or bank card. In contrast to the two previously described exemplary embodiments, the shown enveloping body 27 has three layers, or a three-ply layer. Located on a bottom, if necessary laminated, carrier layer 28 is a circuit layer 29 and a cover layer 30 above it. The carrier layer 28 is designed to provide stability to the enveloping body 27.

The circuit layer 29, which is configured in the manner of a printed circuit board for example, has conductor paths 31, igniter means 32 and contacts 33 (FIG. 8).

Each pyrotechnic charge 26 is assigned an igniter means 32, meaning that the circuit layer 29 of the device shown here has eleven igniter means 32. As in the previously described exemplary embodiments, the igniter means 32 are similarly configured as heating resistors. The heating resistors (pursuant to the top view of FIG. 8) run in a winding or meandering path. Opposite ends of each igniter means 32 are each connected to a conductor path 31 which leads to contacts 33. In the shown exemplary embodiment each conductor path 31, for safety reasons, has three contacts 33, it being possible to vary the number of contacts 33 per conductor path 31 as desired. The conductor paths 31, igniter means 32 and contacts 33 are usually vaporized onto the carrier layer 28, which is made of an insulating material, such as plastic or a laminate comprising a plurality of layers and having at least one insulating layer. The circuit layer 29 and the carrier layer 28 thus form a unit.

The circuit layer 29 is provided on the top side opposite the carrier layer 28 with the cover layer 30. In the shown exemplary embodiment the cover layer 30 is formed merely by a cover coat (referred to by specialists as a "solder resist"). The regions of the igniter means 32 however are left free of solder resist used to form the cover layer 30. These regions are preferably circular areas, and are illustrated as hatchings in FIG. 7. Furthermore, the contacts 33 are largely left uncovered by the cover layer 30. Otherwise, the cover layer 30 completely covers the circuit layer 29. The cover layer 30 thus forms the third layer of the device's enveloping body 27 which is located on the side of the circuit layer 29 opposite the carrier layer 28. Instead of the cover layer 30, it is possible to apply a thick, stable cover layer to the circuit layer 29, with the result that the device is made of two carrier layers and the interjacent circuit layer 29.

Each of the areas of the igniter means 32 left exposed by the cover layer 30 is associated with a pyrotechnic charge 26. Each pyrotechnic charge 26 is applied in a liquid state to the igniter means 32, for example by being dabbed or blotted on. After the pyrotechnic charge 26 has dried, it is covered by an elastic cover coat 34, which can also be a glue dot. The cover coat 34 or glue dot bonds with the cover layer 30 in a liquid-tight seal, with the result that the cover layer 30 together with the point-like positions of the cover coat 34 over each pyrotechnic charge 26 form a continuously closed covering of the top side of the circuit layer 29. Only the contacts 33 remain exposed, i.e. are not covered by the top side of the circuit layer 29.

In the device shown in FIGS. 7 to 9, all contacts 33 are assigned to a narrow transverse edge area of the enveloping body 27. The contacts 33 lie adjacent to one another on a contact strip 35 which proceeds from a transverse edge area. Here all contacts 33 are exposed on the top side of the carrier layer 28, making it therefore possible for them to come into contact on this side with a firing apparatus. Located between two groups of contacts 33 in the contact strip 35 is a slit 36 open at the transverse edge. This slit 36 serves as an indicator for the firing apparatus that a device has been inserted in it and what kind of device is involved, in particular with respect to the number of pyrotechnic charges 26 contained in the device and the type of pyrotechnic charges 26 that are present.

Furthermore, the enveloping body 27 of the device shown here has notches 37 and cutouts 38 at opposite longitudinal edges. In the shown exemplary embodiment, these are two identical slot-like notches 37 on opposite longitudinal edges and two opposite identical rectangular cutouts 38 at opposing corner regions of the enveloping body 27. The notches 37 accommodate ejectors of the firing apparatus which can push the device out of the firing apparatus. The cutouts 38 serve to center the device in order that the contacts 33 properly fit into the provided contact positions of the firing apparatus.

The elastic cover coat 34 for covering the pyrotechnic charges 26 rips apart upon ignition of the pyrotechnic charges 26. This means that the pyrotechnic charges 26 can be discharged without having the cover coat 34 or the glue dots separate from the enveloping body 27, in particular from the carrier layer 28. This prevents any fragments of the enveloping body 27, in particular of the cover coat 34 or glue dots, from dislodging and scattering in an uncontrolled manner when the respective pyrotechnic charge 26 is ignited.

A variation of the device not shown in the drawing pursuant to FIG. 7 to 9 has an additional layer, namely a blister layer with convexities at the position of the pyrotechnic charges. 26. The blister layer can be made from thin plastic film or aluminum. A powdered pyrotechnic charge or a powder/liquid mixture of the pyrotechnic charge 26 can be put in the cup-shaped convexities which are each assigned to the respective igniter means 32. After the convexities assigned to the respective pyrotechnic charges 26 have been filled with the pyrotechnic charge 26, the blister layer is joined with the cover layer 30, specifically by adhesive bonding, sealing or the like. In the process, the pyrotechnic charges 26 arranged in the convexities of the blister layer assume a position directly above the igniter means 32, which are exposed in part by the cover layer 30. The device previously described thus has, in addition to the device of FIGS. 7 to 9, a further layer, namely the blister layer. But it is also conceivable that the cover layer 30 is omitted entirely in this device in that the conductor path 31 and contacts 33 of the circuit layers 29 are covered by the blister layer preferably comprising an insulating material such as plastic film. The convexities for accommodating the pyrotechnic charges 26 can be provided with weakening lines 24 in the manner of the convexities 22 of the first exemplary embodiment (see FIG. 1).

Alternative devices are also conceivable which are built as a combination of the individual layers of the previously described devices. For example, a device is conceivable in which a top laminate layer 16 with openings 21 for receiving the pyrotechnic charges 10 above the igniter means 16 as well as a cover layer 25 are arranged on the carrier layer 28 with the circuit layer 29 and, if applicable, on the cover layer 30, pursuant to the exemplary embodiments of FIG. 4 or 6.

LIST OF DESIGNATIONS

10 pyrotechnic charge
11 enveloping body
12 igniter means
13 conductor path
14 contact
15 carrier layer
16 top laminate layer
17 circuit layer
18 bottom laminate layer
19 cutout
20 chip
21 opening
22 convexity
23 cavity
24 weakening line
25 cover layer
26 pyrotechnic charge
27 enveloping body
28 carrier layer
29 circuit layer
30 cover layer
31 conductor path
32 detonating agent
33 contact
34 cover coat
35 contact strip
36 slit
37 notch
38 cutout

What is claimed is:

1. A device for generating pyrotechnic effects having pyrotechnic charges (26) and igniter means (32) which are housed in a common plate-like enveloping body (27), wherein:

the plate-like enveloping body (27) is formed from a plurality of layers disposed one above the other and connected to each other;

one of the plurality of layers of the enveloping body (27) is a carrier layer (28) that provides the enveloping body (27) with a stable shape;

a circuit layer (29) is located on one side of the carrier layer (28), the circuit layer (29) comprises areas of the igniter means (32);

a cover layer (30) at least partially covers an exposed side of the circuit layer (29);

the areas of the igniter means (32) are left exposed by the cover layer (30);

pyrotechnic charges (26) are provided on the areas of the igniter means (32) wherein each of the pyrotechnic charges (26) is assigned to one of the igniter means (32);

the pyrotechnic charges (26) are covered by a cover coat (34); and the plate-like enveloping body (27) is configured with a shape and area approximating that of a credit card or bank card.

2. The device according to claim 1, wherein each of the plurality of layers is at least partially flat in design and have approximately the same surface area.

3. The device according to claim 1, wherein the cover layer (30) comprises openings (21) at the igniter means (12, 32).

4. The device according to claim 1, wherein at least one of igniter means (12, 32) is configured as a heating resistor.

5. The device according to claim 4, wherein the heating resistor has a meandering design.

6. The device according to claim 4, wherein the heating resistor is part of an electroconductive circuit and the electroconductive circuit is part of the circuit layer.

7. The device according to claim 1, wherein each of the pyrotechnic charges (26) is covered by a point-like position of the cover coat (34).

8. The device according to claim 1, wherein the cover coat (34) is bonded with the cover layer (30) in a liquid-tight seal such that the cover layer (30) together with point-like positions of the cover coat (34) over each of the pyrotechnic charges (26) form a continuously closed covering of the exposed side of the circuit layer (29).

9. The device according to claim 1, wherein the carrier layer (28) is laminated.

10. The device according to claim 1, wherein the cover layer (30) is an insulating film.

11. The device according to claim 1, wherein the cover layer (30) is formed by a solder resist.

12. The device according to claim 1, wherein the cover layer (30) is a coating of paint.

13. A device for generating pyrotechnic effects having pyrotechnic charges (26) and igniter means (32), wherein:

a) the igniter means (32) are parts of a circuit layer (29);

b) the circuit layer (29) is located on a stable-shaped carrier layer (28);

c) a cover layer (30) at least partially covers an exposed side of the circuit layer (29);

d) areas of the igniter means (32) are left exposed by the cover layer (30);

e) the pyrotechnic charges (26) are provided on the areas of the igniter means (32), whereby each of the pyrotechnic charges (26) is assigned to the igniter means (32) on which the pyrotechnic charge (26) is provided or to its own igniter means (32);

f) the pyrotechnic charges (26) are covered by a cover coat (34); and g) the stable-shaped carrier layer (28) is configured with a shape and area approximating that of a credit card or bank card.

14. The device according to claim 13, wherein each of the plurality of layers is at least partially flat in design and have approximately the same surface area.

15. The device according to claim 13, wherein the cover layer (30) comprises openings (21) at the igniter means (12, 32).

16. The device according to claim 13, wherein at least one of igniter means (12, 32) is configured as a heating resistor.

17. The device according to claim 16, wherein the heating resistor has a meandering design.

18. The device according to claim 16, wherein the heating resistor is part of an electroconductive circuit and the electroconductive circuit is part of the circuit layer.

19. The device according to claim 13, wherein each of the pyrotechnic charges (26) is covered by a point-like position of the cover coat (34).

20. The device according to claim 13, wherein the cover coat (34) is bonded with the cover layer (30) in a liquid-tight seal such that the cover layer (30) together with point-like positions of the cover coat (34) over each of the pyrotechnic charges (26) form a continuously closed covering of the exposed side of the circuit layer (29).

21. The device according to claim 13, wherein the carrier layer (28) is laminated.

22. The device according to claim 13, wherein the cover layer (30) is an insulating film.

23. The device according to claim 13, wherein the cover layer (30) is formed by a solder resist.

24. The device according to claim 13, wherein the cover layer (30) is a coating of paint.

* * * * *